US006145818A

United States Patent [19]

Herbst

[11] Patent Number: 6,145,818

[45] Date of Patent: Nov. 14, 2000

[54] HEAT EXCHANGER

[76] Inventor: Donald Herbst, Marienplatz 11, D-12207 Berlin, Germany

[21] Appl. No.: 09/194,549

[22] PCT Filed: May 23, 1997

[86] PCT No.: PCT/DE97/01091

§ 371 Date: Jan. 14, 1999

§ 102(e) Date: Jan. 14, 1999

[87] PCT Pub. No.: WO97/46845

PCT Pub. Date: Dec. 11, 1997

[30] Foreign Application Priority Data

May 30, 1996 [DE] Germany ..... 196 23 245

[51] Int. Cl.[7] ..... B01F 3/04

[52] U.S. Cl. ..... 261/154; 261/DIG. 11; 164/60; 264/46.5

[58] Field of Search ..... 261/147, 148, 261/154, DIG. 11; 165/60; 264/46.5, 261

[56] References Cited

U.S. PATENT DOCUMENTS

| | | | |
|---|---|---|---|
| 185,957 | 1/1877 | Peacock et al. | 261/154 |
| 3,820,353 | 6/1974 | Shiraishi et al. | 261/154 |
| 4,177,044 | 12/1979 | Jernqvist | 261/148 |
| 4,440,698 | 4/1984 | Bloomer | 261/148 |
| 4,461,733 | 7/1984 | Otterbein | 261/154 |
| 4,723,598 | 2/1988 | Yoshio et al. | 264/46.5 |
| 4,976,113 | 12/1990 | Gershuni et al. | 261/154 |

FOREIGN PATENT DOCUMENTS

| | | |
|---|---|---|
| 2526146 | 11/1983 | France . |
| 1504316 | 3/1978 | United Kingdom . |
| 2293231 | 3/1996 | United Kingdom . |

*Primary Examiner*—C. Scott Bushey
*Attorney, Agent, or Firm*—Barnes & Thornburg

[57] ABSTRACT

A heat exchanger includes a tube register through which a liquid to be cooled or heated is conveyed. The heat exchanger provides for contacting an outside surface of the tube register with a spray of water flowing in the same direction on the outside of the tube register as the fluid flows within the tube register, and a stream of air flowing in the opposite direction on the outside of the tube register as the fluid flows within the tube register. The tube register includes capillary tubes which extend generally parallel to each other and which are bent back about one or several lines extending transverse to the directions of air and water flow past the tube register to form layers of the tube register one upon another. The spaces between the capillary tubes are at least partly filled with foamed material.

20 Claims, 2 Drawing Sheets

HEAT EXCHANGER

CROSS-REFERENCES TO RELATED APPLICATIONS

This application is a U.S. national application of international application serial No. PCT/DE97/01091 filed May 23, 1997, which claims priority to German Serial No. 196 23 245.7 filed May 30, 1996.

The invention relates to a heat exchanger.

Such heat exchangers are inserted for example in cooling towers. A brine to be cooled is conveyed through a tube register which is sprayed with water from the outside and air flows therethrough in the opposite direction. The heat of this brine is discharged to the outer air by evaporative cooling of the water. In a typical development the tube register comprises stainless steel tubes having a thickness of 15 millimeters. However, since large heat exchange surfaces are required to achieve economic efficiencies the construction of a cooling tower is costly. Although zinc coated steel tubes are used instead of stainless steel tubes, for such a heat exchanger a very high financial effort and substantial space requirement are still present. Hence, generally only closed cooling towers with relatively low efficiencies or despite the risk of contamination, open cooling towers are used wherein the brine is directly sprayed into an airflow.

A heat exchange element incorporable into a conduit having a rectangular cross-section is already known from the DE 32 16 877 C1 which comprises at least one mat body formed of intersecting grid-like flexible plastic tubes so called capillary tubes having a diameter of 2 mm. The mat body represents a wall penetrating through the conduit transversely to its longitudinal direction which may be formed as a heat exchange element comprising several series connected layers of grid-like intersecting tubes by folding about lines being vertically to its axis. The heat exchange element, however, is not sprayed with water.

Hence, it is the object of the present invention to provide a heat exchanger with a tube register through which a fluid to be cooled or heated is conveyed wherein the tube register is sprayed, in the same direction as the field, with water and air flows therethrough in the opposite direction to the fluid. Said heat exchanger can be perferably inserted, for example, into a cooling tower which comprises a high efficiency despite a low cost effort and a compact design.

According to the invention, a heat exchanger includes a tube register through which a fluid to be cooled or heated is conveyed. The tube register is sprayed, in the same direction as the fluid, with water, and air flows therethrough in the opposite direction to the fluid. The tube register include capillary tubes (1) which extend parallel to each other which are folded such that they are bent back, respectively, about one or several lines vertically extending to its longitudinal direction to form layers of the tube register one upon another. The spaces between the capillary tubes (1) at least are partly filled with foamed material (2). In comparison with conventional heat exchangers, the heat exchange surface is multiplied by the capillary tubes which have substantially smaller diameters than the prior art tubes, and by the application of the foamed material. The capillary tubes can be constructed from plastic, and the foamed material can be produced economically.

Suitably, the foamed material comprises mats disposed between adjacent layers of capillary tubes, or the space between the capillary tubes is entirely foamed.

A conventional bare-tube heat exchanger having a constructional depth of 100 cm and tubes, e.g. with an outer diameter of 15 mm comprises a heat exchange surface of 60 $m^2$ related to $m^2$ of the air admission surface.

If these tubes are substituted according to the invention by capillary tubes having an outer diameter of 3 mm, for example, this surface already increases to a quintuple, namely to 300 $m^2/m^2$ of the air admission surface.

If one respective moulded plate of foamed material having a porosity of 20 ppi (pores per inch) is disposed between two adjacent layers of capillary tubes the foamed material takes up approximately 50% of the heat exchanger volume such that the length of the capillary tubes is shortened by approximately 50%. Nevertheless, the heat exchange surface of the heat exchanger increases up to approximately 800 $m^2/m^2$ of the air admission surface, since the foamed material itself has an interior surface of approximately 1200 $m^2/m^3$.

On the surface of the capillary tubes a material transfer and heat exchange occur between the fluid, preferably brine, flowing through the capillary tubes, the water spraying above the capillary tubes and the air flowing in the opposite direction of the water while within the foamed material between the water and air only material and heat transmissions take place.

Nevertheless, these two kinds of heat exchange are approximately equivalent since the heat transmission coefficient of brine/water with more than 1,000 $W/m^2K$ equals the multiple of the heat and material transmissions on the water/air side which is approximately 150 $W/m^2K$. The smaller heat exchange surface of the capillary tubes is sufficient to heat water to such an extent that it is cooled again in the respective subsequent evaporation path within the foamed material.

In this manner, with the heat exchanger according to the invention a multistage material and heat transmission is achieved. This comprises successively water heating on the first tube layer, water cooling by evaporation within the first foamed material layer, water heating on the second tube layer, water cooling by evaporation within the second foamed material layer, and so on.

In the following, the invention is explained in more detail according to embodiments shown in the figures, in which FIG. 1 is a diagrammatic illustration of a heat exchanger in a vertical section toward the capillary tubes according to a first embodiment of the invention;

FIG. 2 shows a diagrammatic illustration of a heat exchanger in a vertical section toward the capillary tubes according to a second embodiment of the invention; and FIG. 3 shows a diagrammatic illustration of the heat exchanger according to FIG. 2 sectioned within the plane of one capillary tube which is inserted into a cooling tower.

The heat exchanger according to FIG. 1 comprises a plurality of plastic capillary tubes 1 extending in parallel to one another which may comprise a diameter up to approximately 5 mm. As can be seen from FIG. 3, the single capillary tubes 1 are folded meander-shaped such that they extend above several layers respectively. Brine to be cooled is fed to the upper end of the capillary tubes 1, in the figures, which leaves the respective capillary tube 1 at its lower end in the cooled condition.

The tube register comprising capillary tubes 1 is uniformly sprayed with water from above and air flows therethrough which is fed from below. Since the conduction of the brine goes downwards from above it flows in the same direction as the water and in the opposite direction to the air. The heat which is required to evaporate the water is withdrawn from the brine such that it is cooled.

In FIG. 1 one mat of foamed material 2 is disposed between two adjacent layers of the capillary tubes 1. Such one mat is preferably located between all of the adjacent capillary tube layers. By means of the large interior surface of the foamed material 2 the surface being available to evaporate the water is multiplied such that the cooling effect will be substantially improved.

Figure 1:
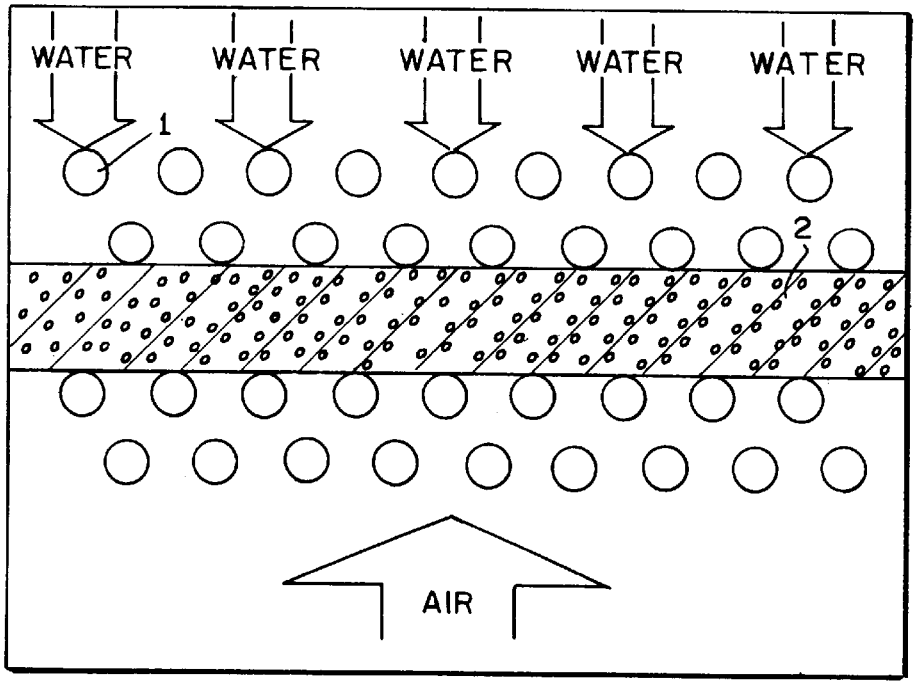
Figure 2:
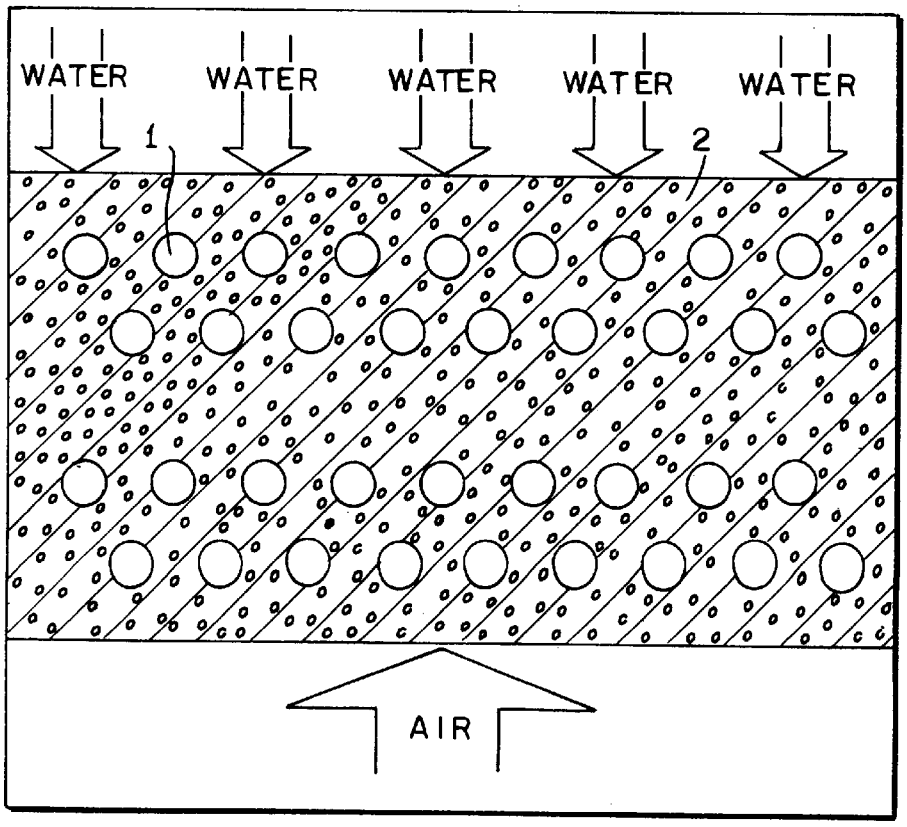
FIG. 2 shows a heat exchanger in which the tube register composed of the capillary tubes 1 has been foamed inside the block such that the entire space between the capillary tubes 1 is filled with foamed material. Under said conditions of the preceding example with this heat exchanger the heat exchange surface can be increased up to approximately 1200 $m^2/m^2$.
Figure 3:
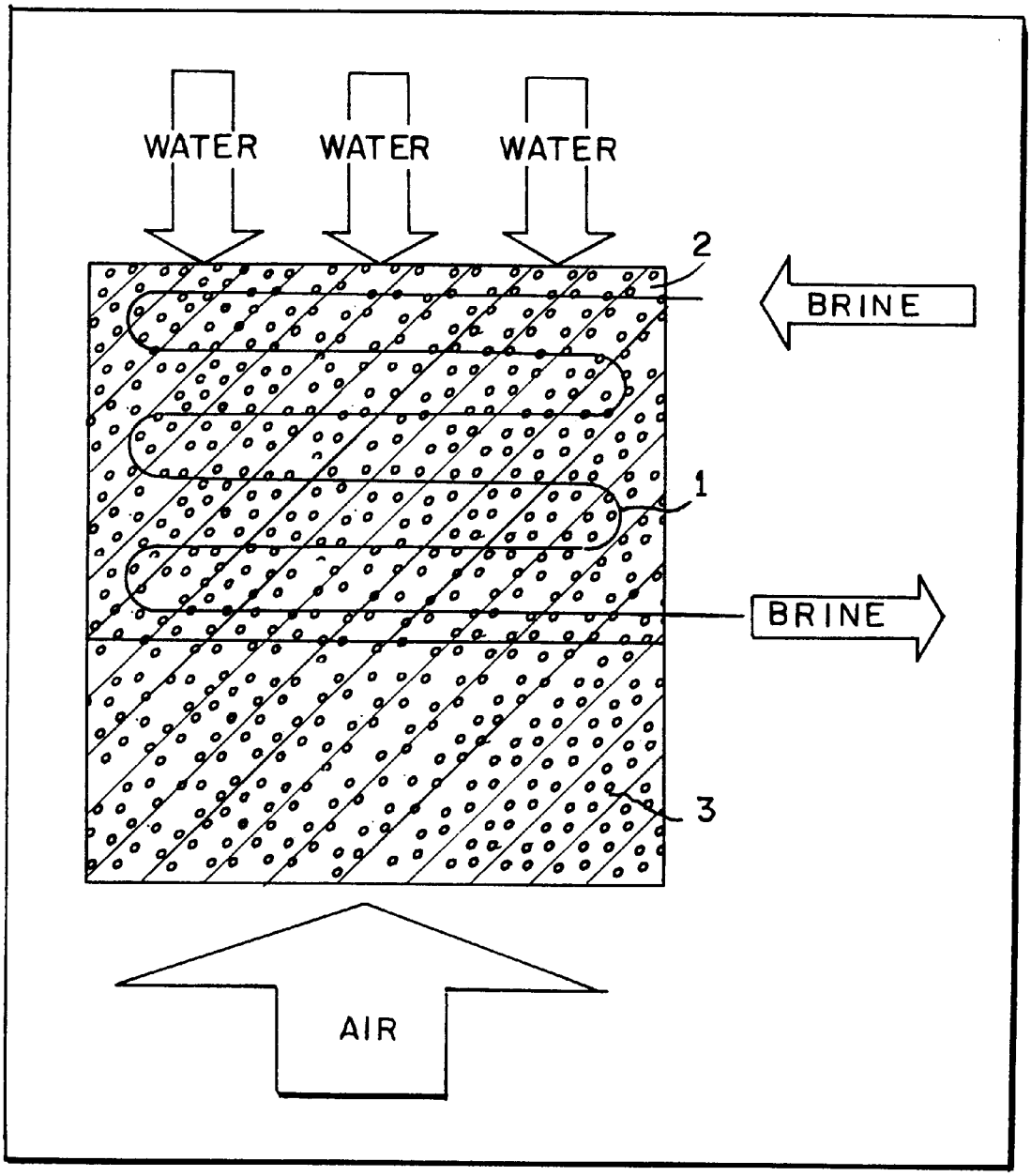
FIG. 3 shows diagrammatically the application of the heat exchanger within a closed cooling tower. Therein, the air is adiabatic precooled by means of evaporation and simultaneously cleaned in a well known manner in the series connected tower packing 3 prior to the introduction into the heat exchanger.

The foamed material mats can be undulatorily formed transversely to the longitudinal direction of the capillary tubes 1. Because of this, the tubes are fixed in its position and comprise a fixed distance from each other. Furthermore, several capillary tubes can be guided in parallel in order to avoid a water side pressure drop.

The heat exchanger according to the invention cannot only be used for cooling the fluid flowing through the capillary tubes but can also be used for the inverted heat and material transport. If the temperature of the fluid is below the temperature of the supplied air this can be cooled and dehumidified.

Another possible application of the heat exchanger is to increase the concentration of a saline solution by spraying it through the heat exchanger and the required evaporation heat is supplied through the fluid. However, this process can also occur in the opposite direction to cool the air flowing therethrough. Then, by means of the fluid the salt water is cooled below the temperature of dew point of air such that water vapour from the air changes into the saline solution. The condensation heat thus released is discharged through the fluid.

Finally, there is a possibility to use capillary tubes for the heat exchanger which are already coated with a coat of foamed material during its production. The heat exchanger is immediately achieved by folding the capillary tubes. The tubes can be manufactured in a two-stage extruder in which in the first stage the capillary tube itself and in the second stage the material forming the coat of foamed material are extruded. Advantageously, the material of the capillary tubes such as polypropylene is used as basic material of the foamed material coat wherein it is additionally mixed with a foaming agent. Because of this, the advantage results that the tubes can be bonded without any problems since no foreign material is present.

What is claimed is:

1. A heat exchanger including a tube register through which a fluid to be cooled or heated is conveyed, the heat exchanger including means for contacting an outside surface of the tube register with a water spray, the water flowing in the same direction on the outside of the tube register as the fluid flows within the tube register, and means for contacting an outside surface of the tube register with a stream of air, the air flowing in the opposite direction on the outside of the tube register as the fluid flows within the tube register, said tube register including capillary tubes (1) extending generally parallel to each other and being folded such that they are bent back, respectively, about one or several lines extending transverse to the directions of air and water flow past the tube register to form layers of the tube register one upon another, the spaces between the capillary tubes (1) being at least are partly filled with foamed material (2).

2. The apparatus of claim 1 wherein adjacent layers of the capillary tubes (1) are separated from each other by a foamed mat.

3. The apparatus of claim 2 wherein said foamed mats are undulatorily formed to establish predetermined distances between parallel capillary tubes (1) separated by said foamed mats.

4. The apparatus of claim 1 wherein the space between the capillary tubes (1) is entirely foamed.

5. The apparatus of claim 1 wherein said capillary tubes (1) are coated with a foamed material layer.

6. The apparatus of claim 5 wherein said capillary tubes (1) and said foamed material layer comprise the same material.

7. The apparatus of claim 1 wherein said capillary tubes (1) comprise plastic.

8. The apparatus of claim 1 wherein said capillary tubes (1) have a diameter in the range of approximately 2 to 5 millimeters.

9. The apparatus of claim 1 wherein the distance between adjacent layers of capillary tubes (1) is in the range of approximately 5 to 10 millimeters.

10. The apparatus of claim 1 wherein said foamed material (2) comprises a porosity of approximately 10 to 30 ppi (pores per inch).

11. The apparatus of claim 1 wherein said fluid is a brine.

12. The apparatus of claim 1 incorporated into a cooling tower.

13. A method for manufacturing a heat exchanger according to claim 5 wherein a capillary tube (1) is produced in a first step and the material forming said foamed material layer is produced in a second step.

14. The method of claim 13 wherein the same material is used in the first step and in the second step, and in the second step the material is mixed with a foaming agent.

15. The apparatus of claim 2 wherein said capillary tubes (1) comprise plastic.

16. The apparatus of claim 3 wherein said capillary tubes (1) comprise plastic.

17. The apparatus of claim 4 wherein said capillary tubes (1) comprise plastic.

18. The apparatus of claim 5 wherein said capillary tubes (1) comprise plastic.

19. The apparatus of claim 6 wherein said capillary tubes (1) comprise plastic.

20. The apparatus of claim 8 wherein said capillary tubes comprise plastic.

* * * * *